US006474796B1

(12) United States Patent
Ishinaga

(10) Patent No.: US 6,474,796 B1
(45) Date of Patent: Nov. 5, 2002

(54) METHOD FOR FILLING A LIQUID INTO A LIQUID CONTAINER, A FILLING UNIT FOR EXECUTING THE FILLING METHOD, A LIQUID CONTAINER MANUFACTURED ACCORDING TO THE FILLING METHOD AND A LIQUID EJECTION APPARATUS

(75) Inventor: Hiroyuki Ishinaga, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/985,314

(22) Filed: Dec. 4, 1997

(30) Foreign Application Priority Data

Dec. 5, 1996 (JP) ..... 8/325328
Nov. 21, 1997 (JP) ..... 9/321120

(51) Int. Cl.[7] ..... B41J 2/175; B65B 31/00
(52) U.S. Cl. ..... 347/85; 141/7
(58) Field of Search ..... 347/84, 85, 86, 347/87; 141/4, 7, 285

(56) References Cited

U.S. PATENT DOCUMENTS

| | | | | |
|---|---|---|---|---|
| 5,481,289 A | | 1/1996 | Arashima et al. | 347/93 |
| 5,502,479 A | | 3/1996 | Ishinaga et al. | 347/93 |
| 5,619,238 A | | 4/1997 | Higuma et al. | 347/86 |
| 5,790,157 A | * | 8/1998 | Higuma et al. | 347/85 |
| 6,058,984 A | * | 5/2000 | Sato | 141/7 |

FOREIGN PATENT DOCUMENTS

| | | | |
|---|---|---|---|
| EP | 493058 | | 7/1992 |
| EP | 562733 | | 9/1993 |
| EP | 580433 | | 1/1994 |
| EP | 640484 | | 3/1995 |
| EP | 703 083 | * | 3/1996 |
| EP | 719646 | | 7/1996 |
| JP | 06040043 | | 2/1994 |
| JP | 06226990 | | 8/1994 |
| JP | 07108688 | | 4/1995 |
| JP | 07125232 | | 5/1995 |
| JP | 08090785 | | 4/1996 |
| JP | 08132636 | | 5/1996 |

* cited by examiner

*Primary Examiner*—Michael Nghiem
(74) *Attorney, Agent, or Firm*—Fitzpatrick, Cella, Harper & Scinto

(57) ABSTRACT

A simple and high productivity liquid filling method is provided for a small-size liquid container having a high efficiency of use in which an amount of accommodated ink per unit volume is increased and a stable liquid supply can be realized. This method fills a liquid into a liquid container, which includes a first chamber incorporating a negative pressure Generating member and including a liquid supply portion and an atmospheric-air communicating portion, and a second chamber including a communicating portion communicating with the first chamber and forming a substantially closed space. The method includes the step of prohibiting discharge of air within one of the first chamber and the second chamber, and simultaneously filling a liquid into the other chamber while discharging air within the other chamber to the outside of the liquid container, in a state in which the communicating portion is placed at a lower position in a direction of gravity.

13 Claims, 9 Drawing Sheets

METHOD FOR FILLING A LIQUID INTO A LIQUID CONTAINER, A FILLING UNIT FOR EXECUTING THE FILLING METHOD, A LIQUID CONTAINER MANUFACTURED ACCORDING TO THE FILLING METHOD AND A LIQUID EJECTION APPARATUS

BACKGROUND OF THE INVENTION

1. Field of the Invention

This invention relates to a method for filling a liquid into a liquid container having a liquid accommodating chamber, a filling unit for executing the filling method, and a liquid container manufactured according to the filling method. More particularly, the invention relates to a method for filling a liquid into a liquid container used in a liquid discharging apparatus, such as an ink-jet recording apparatus or the like, a filling unit, and a liquid container manufactured according to the filling method.

2. Description of the Related Art

For a liquid container used in a liquid discharging apparatus, particularly an ink cartridge used in an ink-jet recording apparatus, it is required, for example, to reliably supply ink corresponding to the amount of ink discharged from a recording means while the recording means operates, and not to leak ink from discharging ports while the recording means does not operate.

In order to satisfy such conditions, a mechanism for generating a back pressure for ink supplied to the recording means is often used in an ink cartridge. Since the back pressure causes the pressure of discharging ports of the recording means to be negative with respect to the atmospheric pressure, it is called a negative pressure.

One of the easiest ways to generate a negative pressure is to utilize a capillary force of a porous member (negative pressure generating member), such as a sponge or the like. The assignee of the present application has proposed, in Japanese Patent Laid-Open Application (Kokai) No. 7-108688 (1995), a small-size ink-jet cartridge having a high efficiency of use which utilizes such a porous member, and which nevertheless can increase the amount of accommodated ink per unit volume of the ink cartridge and realize stable ink supply.

FIG. 8 is a schematic cross-sectional view illustrating an ink cartridge having the above-described configuration. The inside of an ink cartridge 101 is divided into two spaces by a partition 103 having a communicating hole (communicating portion) 102. One of the spaces is an ink accommodating chamber (second chamber) 104 which is closed except for the communicating hole 102 of the partition 103 and directly holds ink 90 without the ink 80 being mixed with other materials. The other space is a negative-pressure-generating-member accommodating chamber (first chamber) 106 which accommodates a negative pressure generating member 105. An atmospheric-air communicating portion 107 for introducing the atmospheric air into the ink cartridge in accordance with consumption of ink, and a supply port (liquid supply portion) 108 for supplying a recording head with ink are formed in a wall of the negative-pressure-generating-member accommodating chamber 106.

In such a tank structure, when ink 80 in the negative pressure generating member 105 is consumed by the recording head, ink is filled from the ink accommodating chamber 104 into the negative pressure generating member 105 of the negative-pressure-generating-member accommodating chamber 106 through the communicating hole 102 of the partition 103. At that time, while the pressure within the ink accommodating chamber 104 is reduced, air entering from the atmospheric-air communicating portion 107 and passing through the negative-pressure-generating-member accommodating chamber 106 enters the ink accommodating chamber 104 via the communicating hole 102 of the partition 103 to mitigate the reduced pressure within the ink accommodating chamber 104. Accordingly, even if; ink is consumed by the recording head, ink fills the absorbing member (the negative pressure generating member 105) in accordance with the consumed amount of ink, so that the negative pressure generating member 105 holds a constant amount of ink and maintains the negative pressure with respect to the recording head substantially constant, to stabilize ink supply to the recording head.

Particularly, as described in Japanese Patent Laid-Open Application (Kokai) No. 6-40043 (1994), by forming a structure for urging introduction of the atmospheric air (for example, a channel 110 or the like) in the vicinity of the communicating portion between the negative-pressure-generating-member accommodating chamber and the ink accommodating chamber, ink can be supplied in a more advantageous manner. Alternatively, as described in Japanese Patent Laid-Open Application (Kokai) No. 7-108688 (1995), an atmospheric-air communicating portion may be provided at an upper portion of the ink cartridge, and a space (buffer portion) 109 where the negative pressure generating member is absent may be provided in the vicinity of the atmospheric-air communicating portion.

Various methods for injecting ink into an ink cartridge having the above-described configuration are known. In one method, as disclosed in Japanese Patent Laid-Open Application (Kokai) No. 8-090785 (1996), ink is injected by providing an appropriate timing between the posture of the ink tank and opening/closing of the ink supply port and the atmospheric-air communicating portion while always inclining the ink cartridge. In another method, as disclosed in Japanese Patent Laid-Open Application (Kokai) No. 8-132636 (1996), ink is injected while reducing the pressure of the ink cartridge.

As for methods for refilling ink into the above-described ink cartridge, for example, as disclosed in Japanese Patent Laid-Open Application No. 6-226990 (1994), a method is known in which a plug is provided at an upper portion of the ink accommodating chamber, the plug is opened before ink in the negative-pressure-generating-member accommodating chamber is consumed to less than a predetermined amount, and ink is injected from an opening closed by the plug into the ink chamber using a syringe or the like.

The above-described ink injection methods are satisfactory from the viewpoint of assuredly injecting ink into an ink cartridge without causing leakage of ink.

For future use, however, in accordance with the recent rapid spread of ink-jet recording apparatuses, it is desired to provide the market with lower-cost ink cartridges, and to provide a low-cost and high-productivity ink injection method in an ink injection process in a process for manufacturing ink tanks.

From such a viewpoint, although the above-described small-size ink cartridge has a high efficiency of use and satisfies the condition of low cost, most of the conventional ink injection methods have a complicated injection process or require a particular apparatus for ink injection.

Furthermore, although the above-described ink refilling method uses a simple injection apparatus, the ink cartridge must in most cases be held in an awkward position during ink injection.

SUMMARY OF THE INVENTION

It is an object of the present invention to provide a liquid container, such as the above-described small-size ink cartridge having a high efficiency of use, or the like, with a simple and high-productivity liquid filling method in which a liquid is filled without greatly changing the position or posture of the container, and without using a complicated process or apparatus.

It is another object of the present invention to provide a liquid filling method having a high accuracy in ink injection into the above-described liquid container.

It is still another object of the present invention to provide a liquid filling method capable of performing more stable liquid supply when using the above-described liquid container.

It is yet another object of the present invention to provide a filling unit and the like which utilize the above-described liquid filling methods.

One aspect of the present invention which achieves these objectives relates to a liquid filling method for filling a liquid into a liquid container, the liquid container including a first chamber incorporating a negative pressure generating member and including a liquid supply portion and an atmospheric-air communicating portion, and a second chamber including a communicating portion communicating with the first chamber and forming a substantially closed space. The method includes the step of prohibiting discharge of air within one of the first chamber and the second chamber, and simultaneously filling a liquid into the other chamber within the other chamber to the outside of the liquid container, in a state in which the communicating portion is placed at a lower position in a direction of gravity. Thus, a simple and high-productivity liquid filling method is realized without using complicated process and apparatus.

This liquid filling method can be applied not only to liquid injection in a process for manufacturing a liquid container, but also to a refilling operation performed after or during the use of a liquid container. That is, the liquid filling method of the present invention can be applied not only to an initial filling operation, but also to a refilling operation after the use of a liquid container has been started.

By using the above-described liquid filling method, a less expensive and high-productivity liquid filling operation for the above-described liquid container can be realized. More preferably, an opening for discharging air may be provided in each of the first chamber and the second chamber, or a region where ink is not filled may be provided near an upper surface of the first chamber.

Another aspect of the present invention which achieves these objectives relates to a liquid filling method for filling a liquid into a liquid container, the liquid container including a first, chamber incorporating a negative pressure generating member and including a liquid supply portion and an atmospheric-air communicating portion, and a second chamber including a communicating portion communicating with the first chamber and forming a substantially closed space. The method includes the step of prohibiting discharge of air within one of the first chamber and the second chamber by blocking the communicating portion with the liquid, and simultaneously filling a liquid into the other chamber while discharging air within the other chamber to the outside of the liquid container. Thus, a simple and high-productivity liquid filling method having a high accuracy in injection is realized without using a complicated process or apparatus.

Particularly, by providing a channel for introducing air at a portion near the communicating portion, the first chamber can immediately block the communicating portion with the liquid. Hence, a filling operation with a higher speed can be performed.

Particularly, when applying this filling method to an initial filling operation, by first filling the liquid into the first chamber, and then filling the liquid into the second chamber, a high-productivity liquid filling method can be provided even when accommodating a liquid or the like which is less well adapted to the negative pressure generating member.

Still another aspect of the present invention which achieves these objectives: relates to a liquid filling method for filling a liquid into a liquid container, the liquid container including a first chamber incorporating a negative pressure generating member and including a liquid supply portion to be connected to a liquid discharging head and an atmospheric-air communicating portion, a second chamber including a communicating portion communicating with the first chamber and forming a substantially closed space, an opening provided at an upper surface of the second chamber, and a region where ink is not filled provided near an upper surface of the first chamber. The method includes the step of prohibiting discharge of air within one of the first chamber and the second chamber by blocking the communicating portion by filling a liquid from a portion of the first chamber near the communicating portion, and simultaneously filling the liquid into the other chamber while discharging air within the other chamber to the outside of the liquid container. Thus, a simple and high-productivity liquid filling method which has a high accuracy in injection and which can perform more stable liquid supply when using the above-described liquid container is realized.

Yet another aspect of the present invention which achieves these objectives relates to a liquid filling method for filling a liquid into a liquid container, the liquid container including a first chamber incorporating a negative pressure generating member and including a liquid supply portion to be connected to a liquid discharging head and an atmospheric-air communicating portion, and a second chamber including a communicating portion communicating with the first chamber and forming a substantially closed space, an opening provided at an upper surface of the second chamber, and a region where ink is not filled provided near an upper surface of the first chamber. The method includes the step of prohibiting discharge of air within one of the first chamber and the second chamber, and simultaneously filling a liquid into the other chamber from the liquid supply portion of the first chamber while discharging air within the other chamber to the outside of the liquid container. Thus, a simple liquid filling method which can perform more stable liquid supply when using the above-described liquid accommodating receptacle is realized.

Yet a further aspect of the present invention which achieves these objectives relates to a liquid filling unit for performing a liquid filling method for a liquid container, the liquid container including a first chamber incorporating a negative pressure generating member, and including a liquid supply portion and an atmospheric-air communicating portion, and a second chamber including a communicating unit communicating with the first chamber and forming a substantially closed space. The method includes the steps of prohibiting discharge of air within one of the first chamber and the second chamber and simultaneously filling a liquid into the other chamber while discharging air within the other chamber to the outside of the liquid container, in a state of a posture in which the communicating portion is placed at a lower position in a direction of gravity, and performing sealing in order to cause the second chamber to be a closed space except for the communicating portion. The filling unit includes a liquid filling unit for injecting a liquid stored therein into the liquid container, a refilling station for controlling the discharge of air, and a seal member for causing the second chamber to be a closed space except for the communicating portion. Thus, a filling unit which utilizes a simple and high-productivity liquid filling method is realized.

Still a further aspect of the present invention which achieves these objectives relates to a liquid container including a first chamber including a liquid supply portion to be connected to a liquid discharging head, and an atmospheric-air communicating portion, and incorporating a negative pressure generating member, and a second chamber, including a communicating portion communicating with the first chamber and forming a substantially closed space. The liquid container is manufactured by prohibiting discharge of air within one of the first chamber and the second chamber and simultaneously filling a liquid into the other chamber while discharging air within the other chamber to the outside of the liquid container, in a state in which the communicating portion is present at a lower position in a direction of gravity, and causing the second chamber to be a closed space except for the communicating portion.

In the foregoing description, the upper surface of the liquid container indicates a surface facing the bottom surface. When the upper surface is present at an upper position, the communicating portion is placed at a lower position in a direction of gravity.

The region where ink is not filled provided near an upper surface of the liquid container indicates not only a space where the negative pressure generating member is absent (a buffer portion), but also a portion where ink is not filled even if the negative pressure generating member is present.

In the following descriptions of the chambers in the liquid container, the expressions "negative-pressure-generating-member accommodating chamber" and "ink (liquid) accommodating chamber" are used when the chamber concerned is in a condition of holding/accommodating ink (liquid), while the expressions "first chamber" and "second chamber" are used in a broader sense when the chamber concerned is suitable for holding/accommodating ink (liquid), for example, when the chamber concerned has an opening dedicated for filling ink.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 9A is a perspective view of the entire liquid discharging recording apparatus; and FIG. 9B is a diagram illustrating a principal portion of the apparatus.

DETAILED DESCRIPTION OF THE PREFERRED EMBODIMENTS

Preferred embodiments of the present invention will now be described in detail with reference to the drawings.

First Embodiment

Figure 1A:
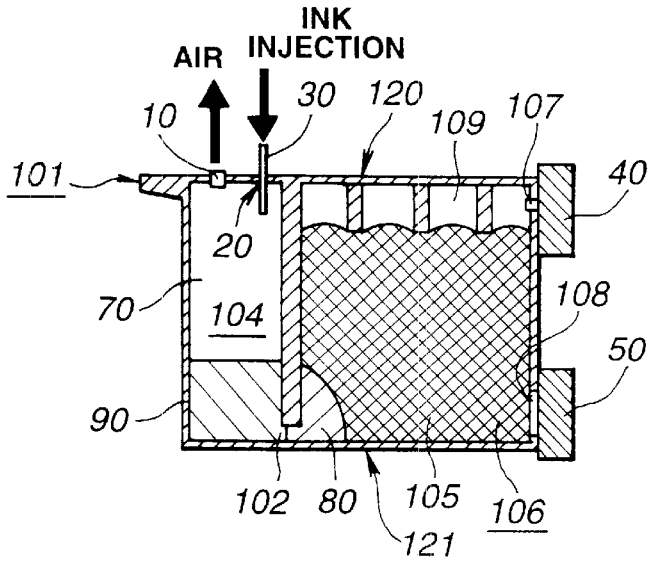
FIGS. 1A, 1B and 1C are diagrams illustrating an ink injection process in an ink cartridge according to a first embodiment of the present invention.
Figure 1B:
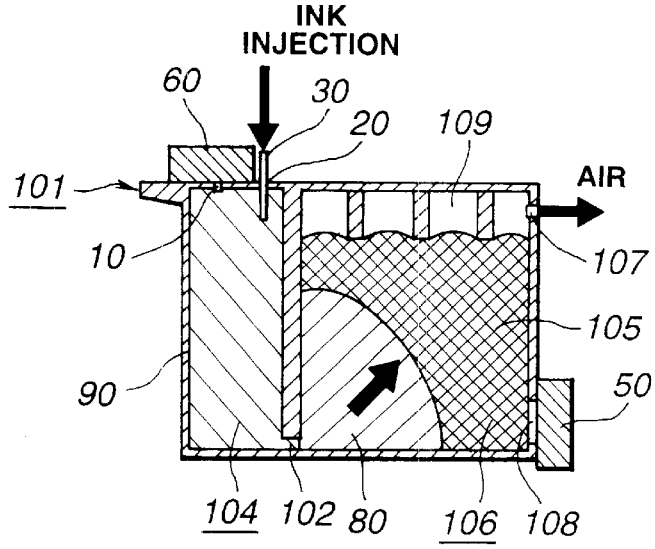
Figure 1C:
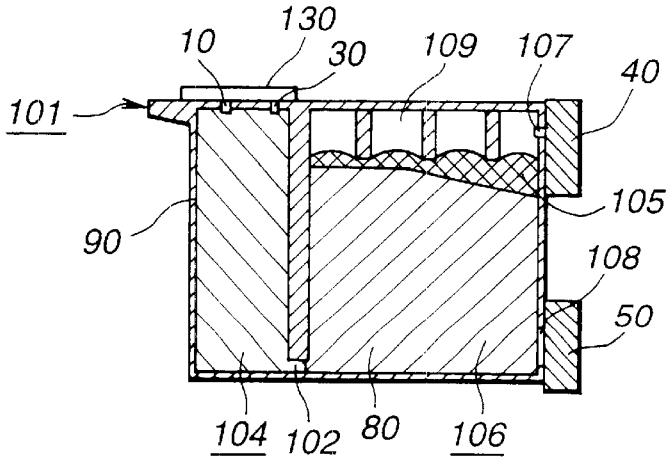

FIGS. 1A, 1B and 1C are diagrams illustrating an ink injection process in an ink cartridge according to a first embodiment of the present invention.

First, as shown in FIG. 1A, an ink cartridge 101 for ink-jet recording is prepared. The cartridge includes a first chamber 106, which includes a liquid supply portion 108 to be connected to an ink-jet head, a negative pressure generating member 105; and an atmospheric-air communicating portion 107 communicating with the negative pressure generating member 105 via a buffer portion 109; the buffer portion 109 serves as a region where ink is not held. The cartridge further includes a second chamber 104, which accommodates only ink to be supplied to the first chamber 106, and communicates with the first chamber 106 only via a communicating portion 102 provided at a position separated from the atmospheric-air communicating portion 107, to provide a substantially closed space.

The ink cartridge 101 of the first embodiment has an air discharging port 10 and an ink injection hole 20 at an upper surface 120 of the second chamber 104. In the ink cartridge 101 of the first embodiment, the upper surface 120 is opposite to and faces the bottom surface 121, so that the air discharging port 10 and the ink injection hole 20 are present at positions so as to face and to be separated from the communicating portion 102. In a state in which the communicating portion 102 is placed at a lower position, the buffer portion 109 is placed above the negative-pressure generating member 105 (near the upper surface 120).

Then, the ink cartridge 101 is fixed in an ink injection device (not shown) in a state in which the communicating portion 102 is placed at a lower position in the direction of gravity. The atmospheric-air communicating portion 107 and the liquid supply portion 108 are blocked by sealing members 40 and 50, respectively, and the air discharging port 10 and the ink injection hole 20 are connected to an air discharging tube (not shown) and an ink injection needle 30, respectively, of the ink injection device.

In this state, injection of ink from the ink injection needle 30 is started. In a state immediately after the start of ink injection as shown in FIG. 1A, the ink is to be filled not only into the second chamber 104, but also into a portion near the communicating portion 102 of the first chamber 106.

Since the atmospheric-air communicating portion 107 and the liquid supply portion 108 are blocked by the sealing members, the first chamber 106 forms a substantially closed space for the atmospheric air except the communicating portion 102. Accordingly, the ink is filled into both of the second chamber 104 and a portion of the negative pressure generating member 105 near the communicating portion 102 until the communicating portion 102 is blocked by the ink. After the communicating portion 102 has been blocked by the ink, filling of the ink into the first chamber 106 is not effected since discharge of the air in the first chamber 106 is prohibited, so that ink 90 is filled into the second chamber 104. Accordingly, the amount of the ink first filled into the negative pressure generating member 105 of the first chamber 106 is the amount which enters member 105 until the communicating portion 102 is blocked by the ink.

While the ink is filled into the second chamber 104, air 70 within the second chamber 104 is discharged from the air discharging port 10. Although in the first embodiment, discharge of air is effected according to natural discharge, discharge of air may be also effected according to forced discharge using an aspirator (not shown).

When the second chamber 104 has been filled with the ink, then (as shown in FIG. 1B) by blocking the air discharging port 10 by the sealing member 60 and opening the first chamber 106 to the atmospheric air by opening the atmospheric-air communicating portion 107, ink 80 is filled into the negative pressure generating member 105 of the first chamber 106, and the air within the negative pressure generating member 105 is discharged from the atmospheric-air communicating portion 107. After blocking the air discharging port 10 by the sealing member 60, the second chamber 104 becomes a substantially closed system for the atmospheric air except the communicating portion 102. Hence, the liquid surface in the second chamber 104 does not change while the ink is being filled into the first chamber 106.

As for ink injection into the first chamber 106 shown in FIG. 1B, since the ink is filled from a portion near the communicating portion 102; the ink can be assuredly filled into a portion which becomes an ink channel during printing in the negative pressure generating member 105. Furthermore, since ink injection can be performed in a state in which the buffer portion 109 is placed at an upper position, the ink does not overflow to the buffer portion 109 by the ink's own weight. The air is discharged from the first chamber 106 through the atmospheric-air communicating portion 107. Since the atmospheric-air communicating portion 107 is provided near the buffer portion 109, the ink does not overflow from the atmospheric-air communicating portion 107 either.

In order to fill the ink 90 into the second chamber 104 without leaving the air 70 therein, it is desirable to first block the air discharging port 10 by the sealing member 60 while blocking the atmospheric-air communicating portion 107, and then to open the atmospheric-air communicating portion 107. By providing a liquid supply portion in the vicinity of a corner portion of an inner wall where the air discharging port 10 is present and tapering this corner portion, it is possible to more assuredly fill the ink 90 within the second chamber 104 without leaving the air 70 therein.

Upon completion of injection of a predetermined amount of ink into the first chamber 106, the ink cartridge 101 is provided by sealing the air discharging port 10 and the ink injection hole 20 using a sealing member 130, after again blocking the atmospheric-air communicating portion 107 by the sealing member 40, as shown in FIG. 1C.

Figure 3A:
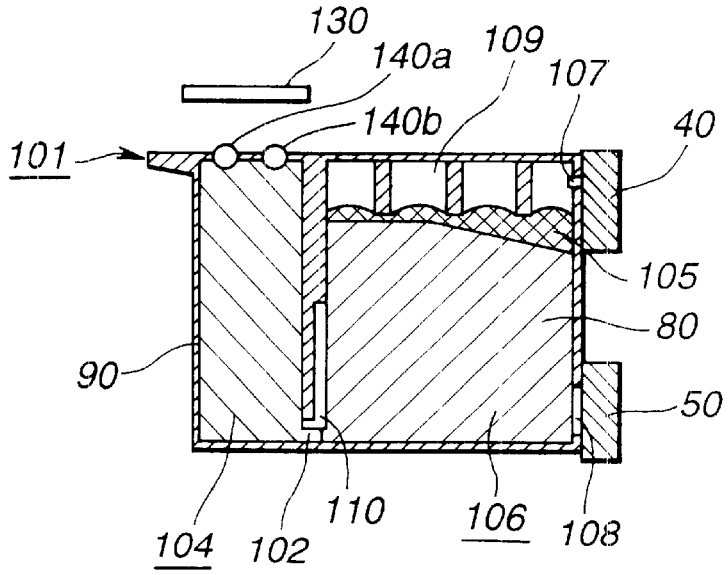
FIGS. 3A and 3B are diagrams illustrating an air-discharging-port sealing process in the ink cartridge of the first embodiment.
Figure 3B:
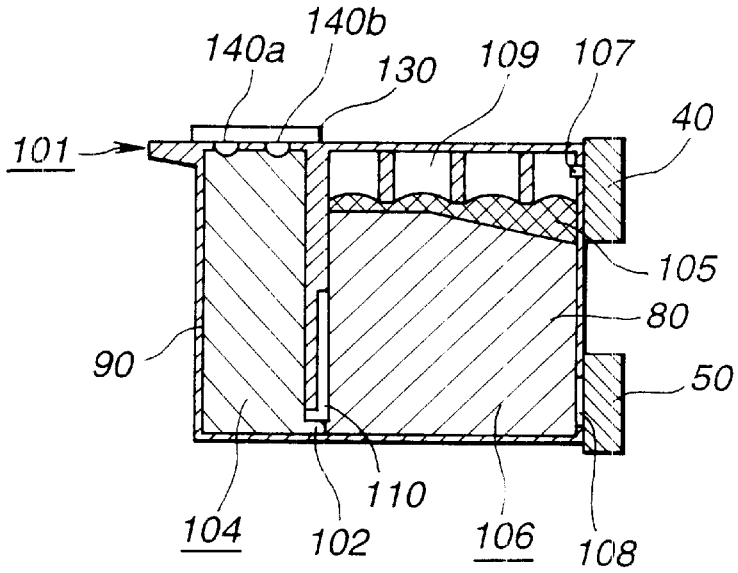

As shown in FIGS. 3A and 3B, the air discharging port 10 and the ink injection hole 20 may be blocked using resin balls 140*a* and 140*b* having a diameter slightly larger than the diameters of the air-discharging port 10 and the ink injection hole 20, respectively, and then may be further sealed using a sealing member 130 made of a metal (comprising an alminum sheet or the like).

In either case, by sealing the air discharging port 10 and the ink injection hole 20 after blocking the atmospheric-air communicating portion 107 and the liquid supply portion 108 by sealing members, it is possible to prevent the ink within the second chamber 104 from flowing to the first chamber 106, and therefore to obtain a desired ink supply performance.

As described above, according to the first embodiment, since the ink cartridge has the air discharging port at the upper surface of the second chamber, ink can be assuredly filled into the first chamber and the second chamber by appropriately opening/closing the atmospheric-air communicating portion and the air discharging port without using a complicated ink injection apparatus, in a state in which the communicating portion remains at a lower position. Particularly, by prohibiting discharge of the air within the first chamber by blocking the communicating portion with the ink, accuracy in injection of ink into the first chamber can be improved.

Second Embodiment

Figure 4A:
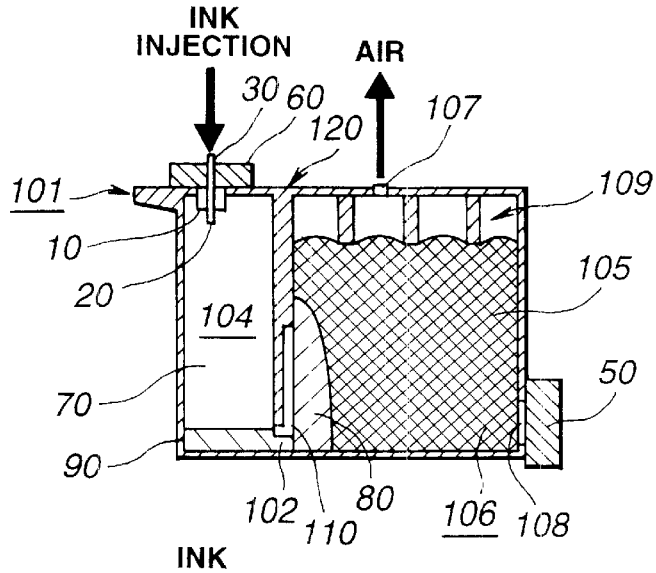
FIGS. 4A, 4B and 4C are diagrams illustrating an ink injection process in an ink cartridge according to a second embodiment of the present invention.
Figure 4B:
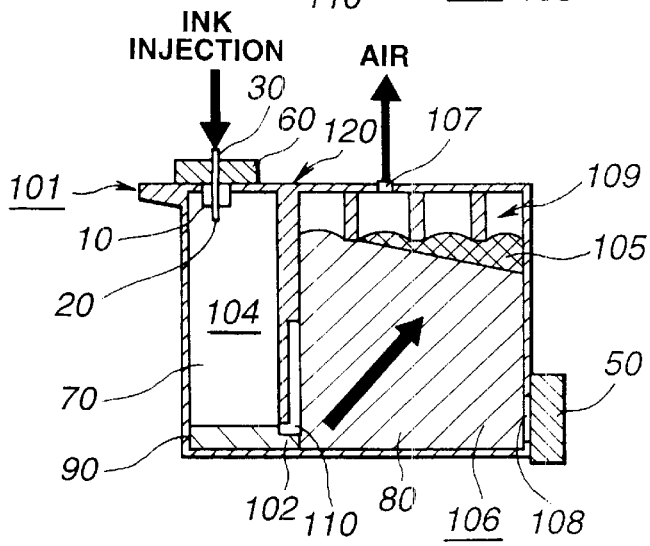
Figure 4C:
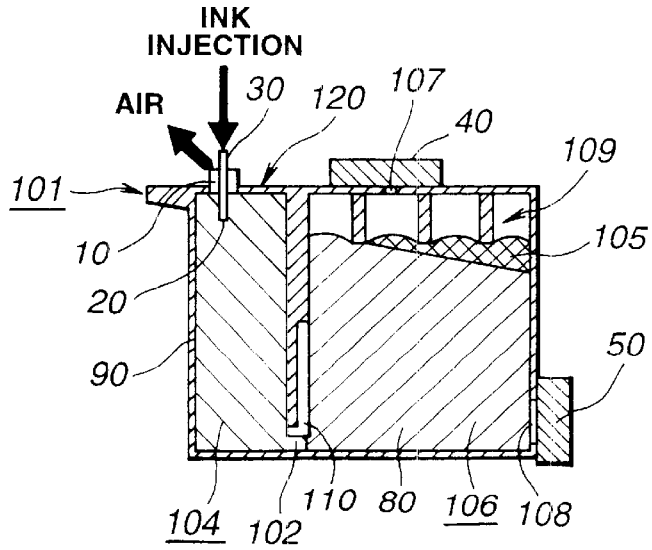

FIGS. 4A, 4B and 4C are diagrams illustrating an ink injection process in an ink cartridge according to a second embodiment of the present invention. In the second embodiment, the shapes of the ink injection hole and the air discharging port, and the sequence of ink filling into the first chamber and the second chamber, differ from those in the first embodiment. In addition, a channel 110 is provided in the vicinity of the communicating portion. The effects of this channel will be described later.

In FIG. 4A, a liquid supply portion for the second chamber 104 comprises an ink injection hole 20 within an air discharging hole 10. Such a configuration can be easily realized by providing a large liquid supply portion at an upper surface 120 of a second chamber 104, and inserting an ink injection needle 30 of an ink injection device (not shown) therein.

In this case, since it is necessary, in some cases, to block the air discharging hole 10 even when the ink injection hole 20 is open during an ink injection process (to be described later), a sealing member 60 for the air discharging port 10 is required for sealing the air discharging port 10 independent of sealing the ink injection hole 20. In the second embodiment, the sealing member 60 comprises a rubber plug or the like.

An ink filling method according to this embodiment of the invention is performed as follows.

First, an ink cartridge having the above-described liquid supply portion in the second chamber 104 is prepared, and is fixed to the ink injection device in a state in which a communicating portion 102 is placed at a lower position. By blocking a liquid supply portion 108 and the air discharging port 10 of a first chamber 106 by sealing members 50 and 60, respectively, and inserting the ink injection needle 30 into the liquid supply portion of the second chamber 104, the ink injection hole 20 is provided in the ink cartridge. By opening an atmospheric-air communicating portion 107 and injecting ink from the ink injection needle 30, the ink is filled into a negative pressure generating member 105 of the first chamber 106 via a communicating portion 102, and the air within a negative pressure generating member 105 is discharged from the atmospheric-air communicating portion 107.

At that time, since a portion near the communicating portion 102 inclusive of the channel 110 is blocked by the ink in both of the first chamber 106 and the second chamber 104, the air is blocked from moving between the first chamber 106 and the second chamber 104. As a result, the second chamber 104 becomes a substantially closed space for the atmospheric air, and the ink is filled from a portion of the negative pressure generating member 105 near the communicating portion 102. Hence, the ink can be assuredly filled at a portion which becomes an ink channel of the negative pressure generating member 105 during printing. At that time, as in the first embodiment, since the ink can be injected in a state in which a buffer portion 109 and the atmospheric-air communicating portion 107 are placed at upper positions, the ink does not overflow from the buffer portion 109.

As shown in FIG. 4B, upon completion of filling of the ink into the negative pressure generating member 105, the injection of the ink is stopped. After blocking the atmospheric-air communicating portion 107 by the sealing member 40, the sealing member 60 is removed to open the second chamber 104 to atmospheric air. Then, as shown in FIG. 4C, when the ink is injected from the ink injection needle 30, since the first chamber 106 is closed to atmospheric air and the second chamber 104 is opened to atmospheric air, the ink is filled into the second chamber 104 while maintaining the liquid surface in the first chamber 106.

By blocking the liquid supply portion of the second chamber 104 after filling the ink into the second chamber 104 and discharging air 70 within the second chamber 104 from the air discharging port 10, the ink cartridge is provided.

Since in the second embodiment, there is a time period filling ink into the second chamber after filling ink into the negative pressure generating member, the method of the second embodiment is effective when using ink which requires a time period to be adapted or to assume a stable state with respect to the negative pressure generating member.

The ink injection hole and the air discharging hole in the second embodiment may have the same shapes as in the first embodiment. Alternatively, the ink injection hole and the air discharging port of the first embodiment may be used in the second embodiment.

Accordingly, by opening one of the first chamber and the second chamber to the atmospheric air and closing the other chamber after filling ink into a portion near the communication portion and the channel between the first chamber and the second chamber, ink can be assuredly filled into the opened chamber.

Although in each of the above-described first and second embodiments, the opening for injecting ink is provided near the upper surface of the second chamber, ink may be injected from a portion near the bottom surface by inserting a hollow needle or the like from the ink injection hole. In this case, in a process of injecting ink into the second chamber, foaming of ink is suppressed.

Third Embodiment

Figure 5A:
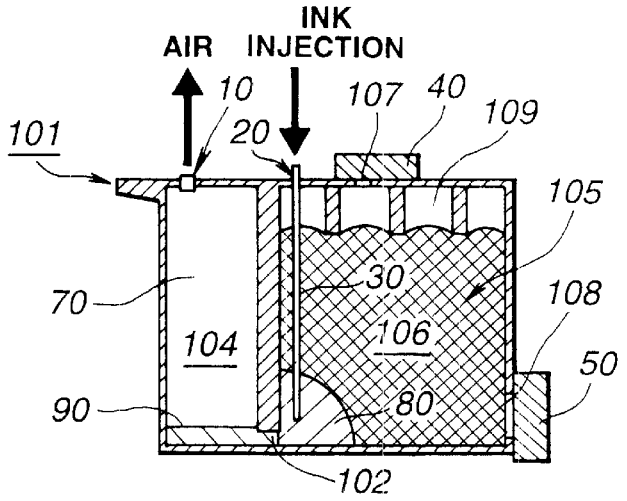
FIGS. 5A, 5B and 5C are diagrams illustrating an ink injection process in an ink cartridge according to a third embodiment of the presents invention.
Figure 5B:
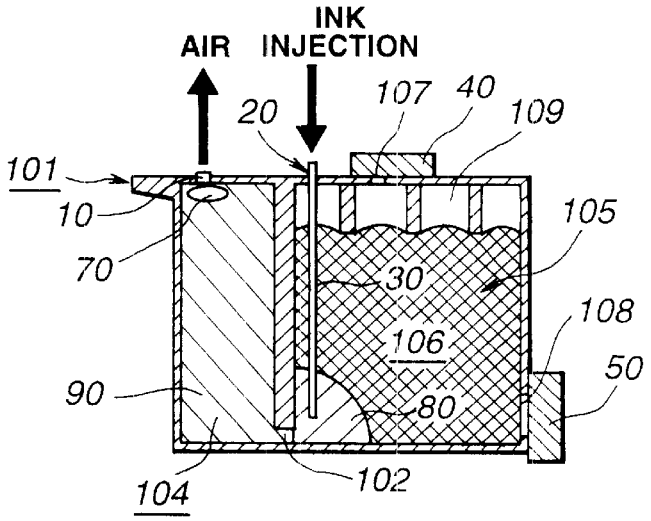
Figure 5C:
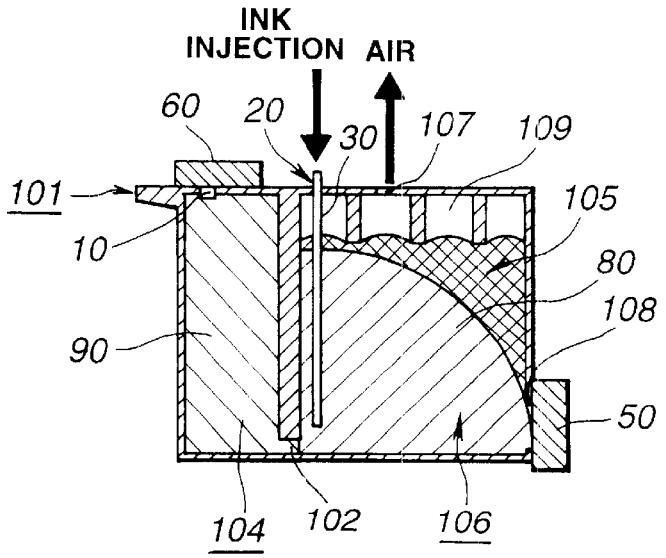

FIGS. 5A, 5B and 5C are diagrams illustrating an ink injection process in an ink cartridge according to a third embodiment of the present invention. In the third embodiment, the position of the ink injection hole is different from the positions in the first and second embodiments.

That is, in the third embodiment, as shown in FIG. 5A, an ink injection hole 20 is provided at an upper surface of a first chamber at a position in the vicinity of a partition. An ink injection needle 30 of an ink injection device passes from the ink injection hole 20 through a negative pressure generating member 105 so that the distal end of the ink injection needle 30 reaches a portion near a communicating portion 102 of the negative pressure generating member 105.

Figure 6A:
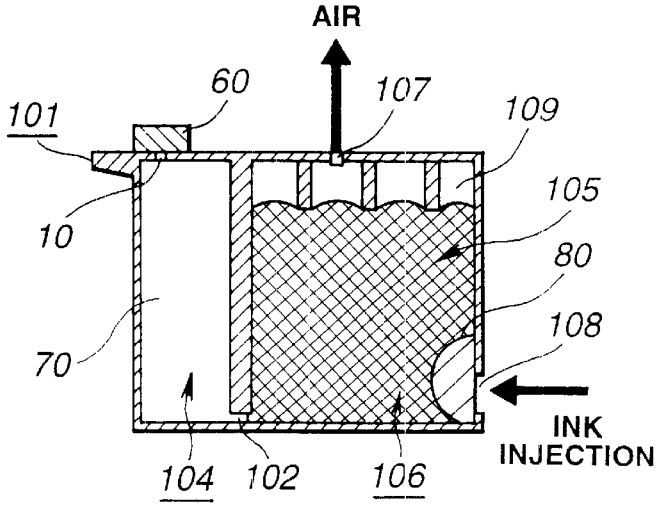
FIGS. 6A, 6B and 6C are diagrams illustrating an ink injection process in an ink cartridge according to a fourth embodiment of the present-invention.

According to this configuration, as shown in FIG. 6A, a portion near the communicating portion 102 between a first chamber 106 and a second chamber 104 can be promptly filled with ink. As in the first embodiment, the amount of ink filled in the negative pressure generating member 105 of the first chamber 106 at that time is an amount of ink which enters member 105 until the communicating portion 102 is blocked by ink.

As a result, by blocking the movement of air via the communicating portion 102, it is possible to realize a state of opening one of the first chamber and the second chamber to the atmospheric air and closing the other chamber in a shorter time period than in the other embodiments. Hence, ink can be assuredly and accurately filled first into the opened chamber. FIGS. 5A, 5B and 5C illustrate a procedure for ink filling when the second chamber is first opened to the atmospheric air.

In contrast to the above-described other embodiments, in the third embodiment, since ink is injected from a portion of the negative pressure generating member near the communicating portion, a larger amount of ink can be made to flow in this portion during an ink filling process. That is, even if the negative pressure generating member has an uneven density distribution, ink can be assuredly filled independent of such unevenness. Accordingly, after providing the ink cartridge as an ink tank, it is possible to prevent the occurrence of incapability of ink supply from the second chamber to the first chamber due to disconnection of ink at a portion near the communicating portion of the negative pressure generating member during printing.

Although each of the above-described first through third embodiments provides a simple and high-productivity liquid filling method having a high accuracy in filling without using a complicated process or apparatus, the object of providing a simple and high-productivity liquid filling method without using a complicated process or apparatus can also be achieved according to the following fourth embodiment of the present invention.

Fourth Embodiment

Figure 6B:
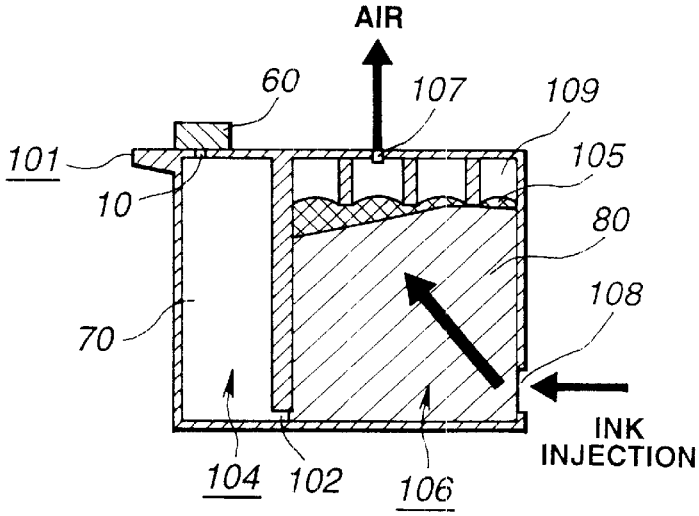
Figure 6C:
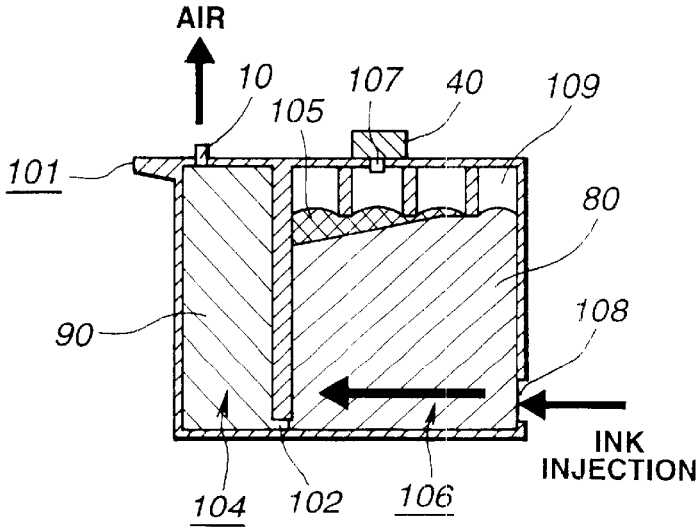

FIGS. 6A, 6B and 6C illustrate an ink injection process in an ink cartridge according to the fourth embodiment of the present invention. The fourth embodiment differs from the above-described embodiments in that the liquid supply portion 108 is used as an ink injection hole.

In contrast to the above-described embodiments, in the fourth embodiment, since the liquid supply portion 108 operates as the ink injection hole, ink is more easily filled first into a first chamber 106. That is, as shown in FIG. 6A, by injecting ink after blocking an air discharging port 10 to cause a second, chamber 104 to be a substantially closed space for the atmospheric air, the ink is assuredly filled into a negative pressure generating member 105, and the air within the negative pressure generating member 105 is discharged to the outside via an atmospheric-air communicating portion 107.

As shown in FIG. 6B, the ink is filled upward after assuredly filling a portion which becomes an ink channel during printing at a bottom portion of the negative pressure generating member 105. After injection of a predetermined amount of ink, by blocking the atmospheric-air communicating portion 107 by a sealing member 40 and instead opening the air discharging port 10, the ink can be filled into the second chamber. At that time, also, the ink is supplied from the liquid supply portion 108 to the second chamber 104 via a communicating portion 102.

In the fourth embodiment, a larger amount of ink can be made to flow between the liquid supply portion 108 and the communicating portion 102. That is, as in the portion near the communicating portion in the third embodiment, even if the negative pressure generating member 105 has an uneven density distribution, ink can be assuredly filled independent of such unevenness. Accordingly, little air remains in the above-described portion within the negative-pressure generating member 105, so that ink can be more assuredly supplied when using the ink tank.

Other Embodiments

A principal portion of the liquid filling method according to each of the embodiments of the present invention has been described. A description will now be provided of modifications of the above-described embodiments, and liquid containers to which the methods of the above-described embodiments can be applied.

In the following description, unless specifically described, each example can be applied to any of the above-described embodiments.

Combination of Liquid Filling Methods

Although each of the methods of the above-described embodiments is executed by itself, ink injection and refilling (to be described later) may be executed, in some cases, by appropriately combining some of the above-described embodiments.

For example, a combination of the first embodiment and the fourth embodiment will be considered. First, the ink injection needle is inserted from the ink injection hole at the upper surface to a portion near the communicating portion of the negative pressure generating member. At the same time, it is arranged so that ink injection can also be performed from the liquid supply portion, and the air discharging port of the second chamber is blocked to cause the second chamber to be substantially closed state with respect to atmospheric air. Then, by starting injection of ink from the ink injection needle and the liquid supply portion, the ink is filled into the first chamber and the second chamber until the communicating portion is blocked by the ink. When the communicating portion has been blocked by the ink, the ink is filled into the negative pressure generating member of the first chamber. Then, by opening the air discharging port of the second chamber after causing the first chamber to be substantially closed space with respect to atmospheric air except the communicating portion, the ink is filled into the second chamber.

When injecting ink from a plurality of injection ports in the above-described manner, if the injection ports are provided in the same chamber, even though the number of ink injection portions is increased, both the effect of the third embodiment of assuredly filling ink in the vicinity of the communicating portion and the effect of the fourth embodiment of assuredly filling ink in a portion between the liquid supply portion and the communicating portion can be realized.

Liquid Discharging Head Cartridge

In the foregoing embodiments, a description has been provided illustrating an ink cartridge having a liquid supply portion to be connected to an ink-jet head. However, the liquid to be discharged from the recording head is not limited to ink. For example, a processing liquid for ink may be discharged. Such a head cartridge will be hereinafter termed a "liquid discharging cartridge".

In the liquid discharging cartridge, although the liquid discharging head unit and the liquid accommodating unit (liquid container) may be detachable from each other as in the above-described embodiments, the liquid discharging head unit and the liquid container may also be always integrated (liquid discharging cartridge), including the case of a refilling method (to be described later) in the first through third embodiments. In this case, by covering a discharging surface of a head cartridge with a cap or the like, this portion can be closed.

Shape of the Liquid Container

The liquid container (including a liquid accommodating unit of a liquid discharging cartridge integrated with a liquid discharging head unit) may have the following configuration in addition to the configurations of the above-described embodiments.

First, as for the first chamber, although a space (buffer portion) where the negative pressure generation member is absent has been described as provided in a portion near the upper surface in the above-described embodiments, this space may be omitted and instead be filled with the negative-pressure generation member. However, it is desirable that the holding member not hold the liquid in this portion, because the liquid may flow to the outside from the liquid accommodating portion or the atmospheric-air communicating portion due, for example, to a slight change in the temperature if the liquid is held in this portion. When using the liquid-filling method of the present invention, since the liquid can be filled in a state in which the upper surface is placed at an upper position including in a refilling operation (to be described later), it is possible to easily prevent filling of the liquid in a region of the negative pressure generating member where the buffer portion is present in the above-descibed embodiments.

As for the negative pressure generating member, the negative pressure generating member used in the above-described embodiments comprises a single structure. This is not necessary, however; for example, a plurality of kinds of urethane sponges having different pore ratios may be used, or a plurality of fiber sheets comprising felt or the like may be laminated, provided that the desired negative pressure can be generated.

As for the atmospheric-air communicating portion, although this portion is utilized as a discharging port for discharging the air in the first chamber in the above-described embodiments, a new opening may be provided at an upper portion (desirably the upper surface) of the first chamber, and the atmospheric-air communicating portion may be always closed during an ink filling process. Although the atmospheric-air communicating portion is provided at the upper surface of the first chamber in the above-described embodiments, the position is not limited to the upper surface provided that it is located in the first chamber.

In the first through third embodiments, as shown in FIGS. 2A, 2B, 2C, 3A and 3B, if the channel 110 is present near the communicating portion, a further effect of promptly filling a predetermined amount of liquid into a chamber where the liquid (ink) is to be first filled can be realized.

The effect of the channel 110 in the first embodiment will now be described with reference to FIGS. 2A, 2B and 2C.

Figure 2A:
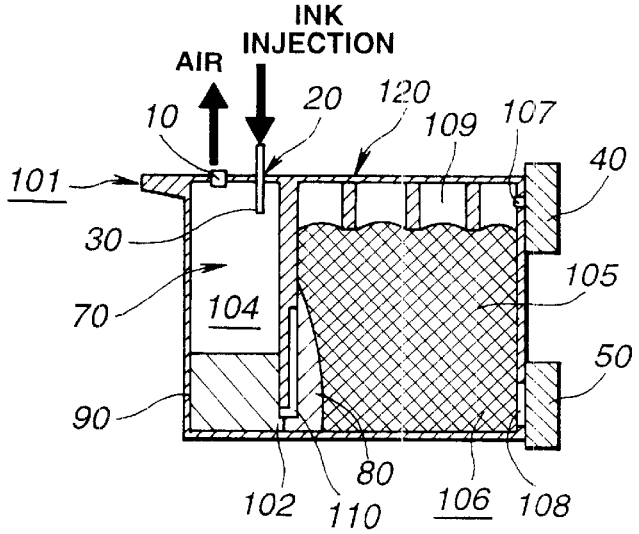
FIGS. 2A, 2B and 2C are diagrams illustrating an ink injection process in an ink cartridge according to a modification of the first embodiment of the present invention.
Figure 2B:
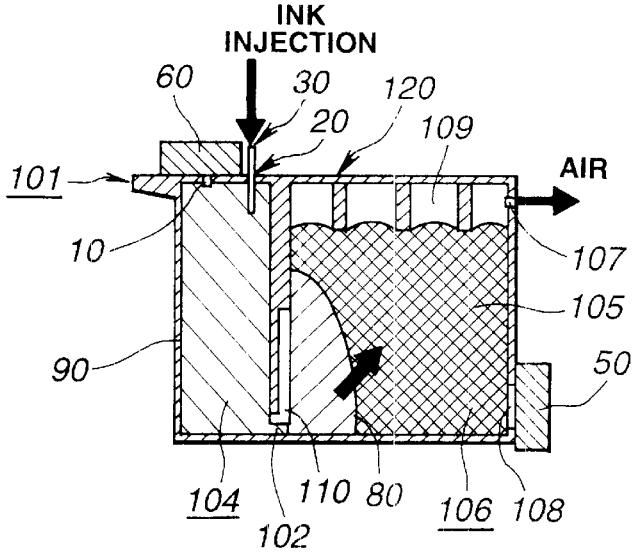
Figure 2C:
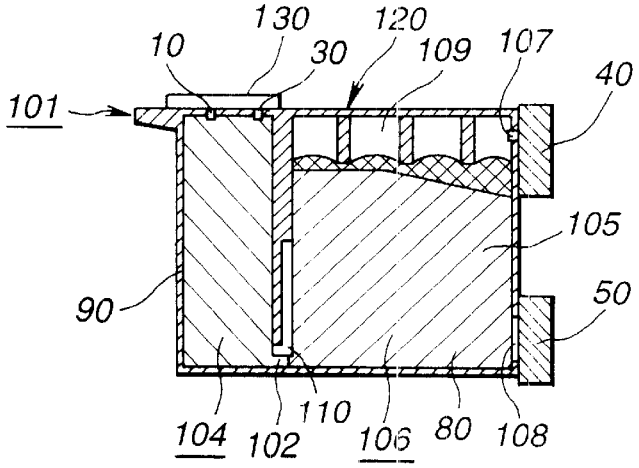

FIGS. 2A, 2B and 2C are diagrams illustrating an ink (liquid) filling process of an ink cartridge according to a modification of the first embodiment of the present invention.

As shown in FIGS. 2A, 2B and 2C, by the presence of the channel 110 in the first chamber at a portion near the communicating portion, a liquid to be filled into the negative pressure generating member present in the vicinity of the channel 110 is filled into the negative pressure generating member via this channel, since this channel has a small flow resistance. When the pore ratio of the negative pressure generating member is uniform, the liquid is assuredly filled into the negative pressure generating member from a region of the first chamber closer to the second chamber, as shown in FIGS. 2A, 2B and 2C. When the process of filling the liquid into the second chamber is started as shown in FIG. 2A, the liquid that is to move to the first chamber 106 promptly blocks this channel which has a small resistance, and is then assuredly filled into the negative pressure generating member 105 in the vicinity, of the communicating portion 102. As a result, blocking of air movement between the first chamber and the second chamber is more promptly effected than when the channel is absent. Accordingly, by injecting a predetermined amount of liquid, the liquid can be assuredly filled without the necessity of detecting the liquid surface in the second chamber.

In addition, when first filling the liquid into the first chamber 106 as in the second embodiment, as shown in FIG. 3A, since the channel 110 is present in the vicinity of the communicating portion 102, the ink (liquid) 80 injected when starting ink injection tends to block the channel 110, and a part of the ink flows to the second chamber 104. As a result, blocking of air movement between the first chamber and the second chamber is more promptly effected than when the channel is absent, and a predetermined amount of liquid can be assuredly filled into the first chamber.

In the third embodiment, also, as in the other embodiments, the same effects can be realized by providing the channel 110. As for the fourth embodiment, as in the other embodiments, the channel 110 may be provided.

As for the second chamber, although each of the above-described embodiments includes at least one opening at the upper surface, and a communicating portion communicating with the first chamber is provided at a bottom portion, a rib for reinforcing the strength of the second chamber may also be provided within the second chamber. Alternatively, as disclosed, for example, in Japanese Patent Laid-Open Application (Kokai) No. 7-125232 (1995), a rib may be extended to the upper surface, and the second chamber may comprise a plurality of small chambers. In this case, in order to fill ink within each small chamber so as to minimize air remaining therein, it is desirable to provide an opening for air discharge at the upper surface of each small chamber.

As for the liquid accommodating receptacle in the first embodiment, for the sake of convenience, one of openings is called an air discharging port, and the other opening is called an ink injecting hole. However, if two openings are present, either of the openings may be called an air discharging port or an ink injecting hole.

Ink Refilling Method

In the foregoing embodiments, a description has been provided illustrating an ink filling method in a process for manufacturing an ink cartridge. However, the ink filling method of the present invention is not limited to ink filling during a manufacturing process, but may also be applied to a method for refilling ink or a liquid into a liquid accommodating receptacle or a head cartridge for liquid discharge after being used.

When refilling ink in a state in which a certain amount of ink remains in the second chamber, in order to prevent leakage of ink from the first chamber, it is desirable to cause the first chamber to be a substantially closed space with respect to the atmospheric air except the communicating portion before performing refilling. On the other hand, when little ink remains in the second chamber, refilling of ink may be started from either of the first chamber and the second chamber because the above-described problem is not present.

An advantage obtained when adopting the methods of the first through third embodiments in ink refilling, in addition to the advantages of the ink filling methods, is that ink can be filled in a state in which the liquid can be supplied to the liquid discharging head. That is, by replenishing the liquid according to one of the liquid filling methods of the first through third embodiments while closing the liquid discharging head unit with a cap or the like, the liquid can be replenished into the cartridge at a predetermined position in the recording apparatus without changing the posture of the cartridge during a printing operation.

Figure 9A:
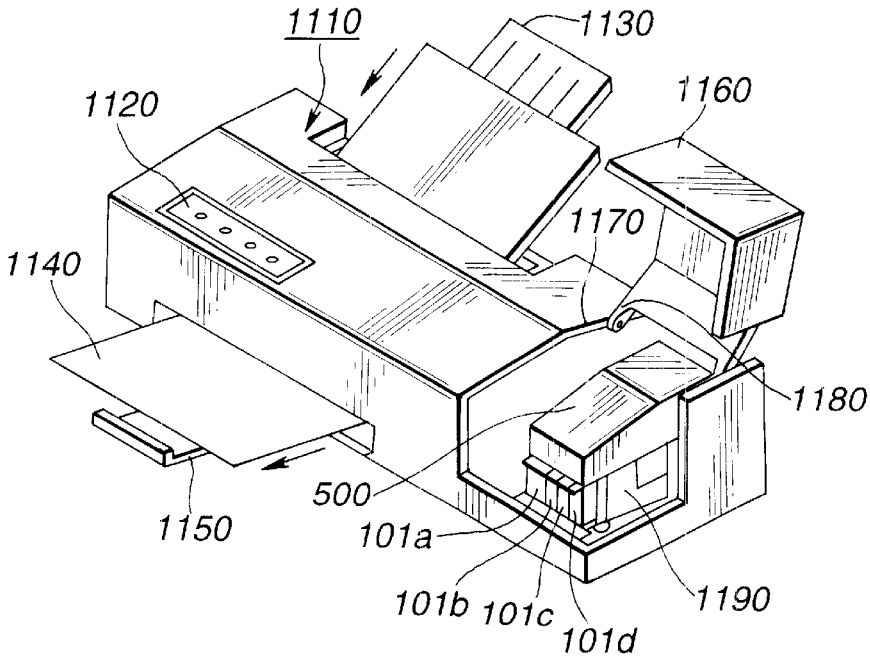
FIGS. 9A and 9B are diagrams illustrating a liquid discharging recording apparatus to which the liquid filling method of the present invention can be applied.
Figure 9B:
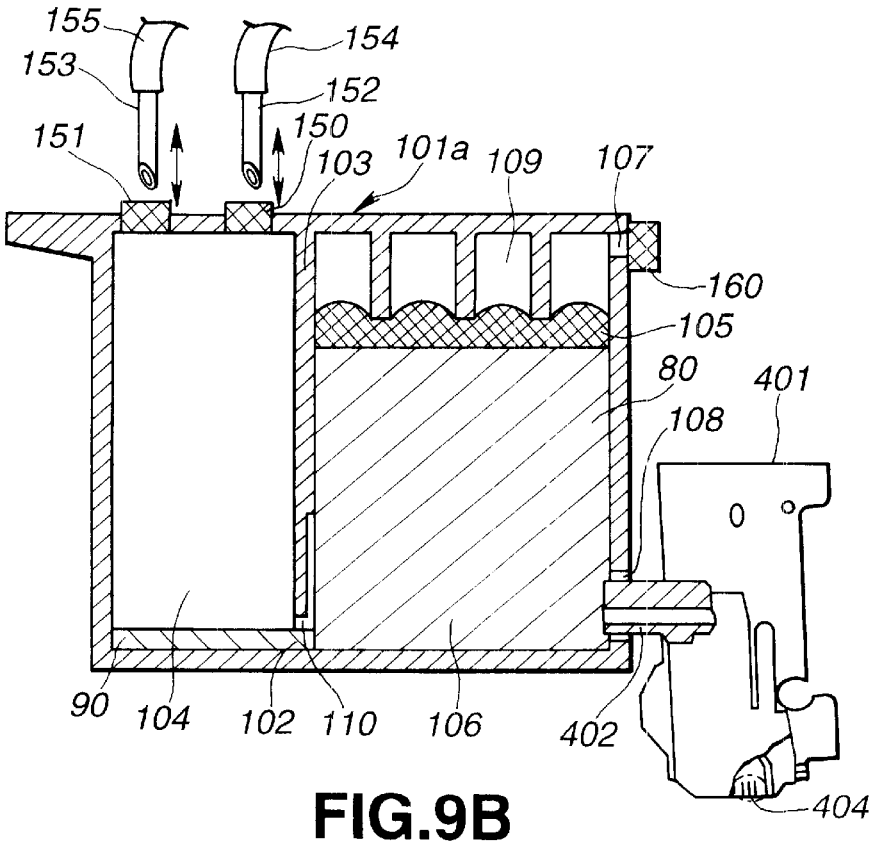

A description will now be provided of a liquid discharging recording apparatus having an ink supply system which utilizes the liquid filling method of the present invention with referece to FIGS. 9A and 9B. FIG. 9A is a schematic perspective view of a color printer, serving as a liquid discharging recording apparatus having a supply system which utilizes the liquid filling method of the first embodiment.

In FIG. 9A, an operation panel 1120 is provided on a front portion of the upper surface of the housing of a liquid discharging recording apparatus (color printer) 1110. A sheet feeding tray 1130 holds sheets (a recording medium) before recording. Reference numeral 1140 represents a sheet discharged passing through a sheet conveying path within the printer 1110. A discharged-sheet tray 1150 holds the sheet 1140. A main-body cover 1160 covers an opening 1170 formed in a right front portion of the housing. The main-body cover 1160 is rotatably mounted on inner sides of the opening 1170 by hinges 1180. A carriage 1190 supported on guides or the like (not shown) is disposed within the housing. The carriage 1190 is provided so as to be reciprocatable in the direction of the width of the sheet passing through the sheet conveying path. Heads, and ink cartridges 101*a*, 101*b*, 101*c* and 101*d* for accommodating black (Bk), cyan (C), magenta (M) and yellow (Y) inks, respectively, are provided on the carriage 1190. A large tank (replenishing container) for black 500 replenishes ink into the ink cartridge 101*a* according to a replenishing method (to be described later).

As shown in FIG. 9B, the ink cartridge 101*a* is connected to a recording head unit 401 at an ink supply port 108 via an ink supply tube 402. An ink injection port and an air discharging port are provided in the ink cartridge 101*a*. Usually, the respective ports (apertures) are closed by aperture closing means, comprising rubber plugs 150 and 151 shown in FIG. 9B, valves, or the like. The color printer 1110 also includes a seal member 160 for blocking an air communicating port of the ink cartridge 110*a*, an ink injection tube 154 for filling ink from the replenishing container into the head cartridge, and an air discharge tube 155 for discharging air within the head cartridge to the outside. Hollow needles 152 and 153, serving as opening/closing means for opening/closing the aperture closing means of the cartridge, are provided at distal ends of the tubes 154 and 155, respectively.

In the recording apparatus having the above-described configuration, as shown in FIG. 9B, for example, at a home position, a discharging port 404 of the recording head unit 401 of the head cartridge is capped by a cap (not shown), and at the same time, the air communicating port is sealed by the sealing member 160. Then, by inserting the hollow needles 152 and 153 into the rubber plugs 150 and 151, respectively, of the tank, and filling ink from the replenishing container via the ink injection tube 154, liquid replenishment can be performed in the same manner as in the first embodiment.

In this case, frequently-used integrated cartridges are adopted as the ink cartridges for filling inks in the recording apparatus. However, a replenishing container may be provided for each of a plurality of cartridges, and the cartridges may, of course, be integrated with the recording heads in the above-described manner.

Arbitrary valves or the like may also be used as the aperture closing means for blocking the apertures of the ink cartridge. The use of means having a self blocking function as in the above-described case is desirable, because a process of sealing the apertures after ink injection becomes unnecessary.

The provision of such plugs having the self blocking function at the apertures may, of course, be applied to any one of the embodiments.

In each of the above-described refilling methods, although an opening for ink injection and an opening for air discharge may be provided in advance in the liquid accommodating receptacle or the liquid discharging head cartridge where the liquid is to be filled, these openings may be newly provided when performing ink refilling. Furthermore, as in the above-described embodiments, the liquid supply portion or the air communicating portion in the first chamber may be utilized depending on the structure of the receptacle or the head cartridge.

Refilling Kit

Figure 7:
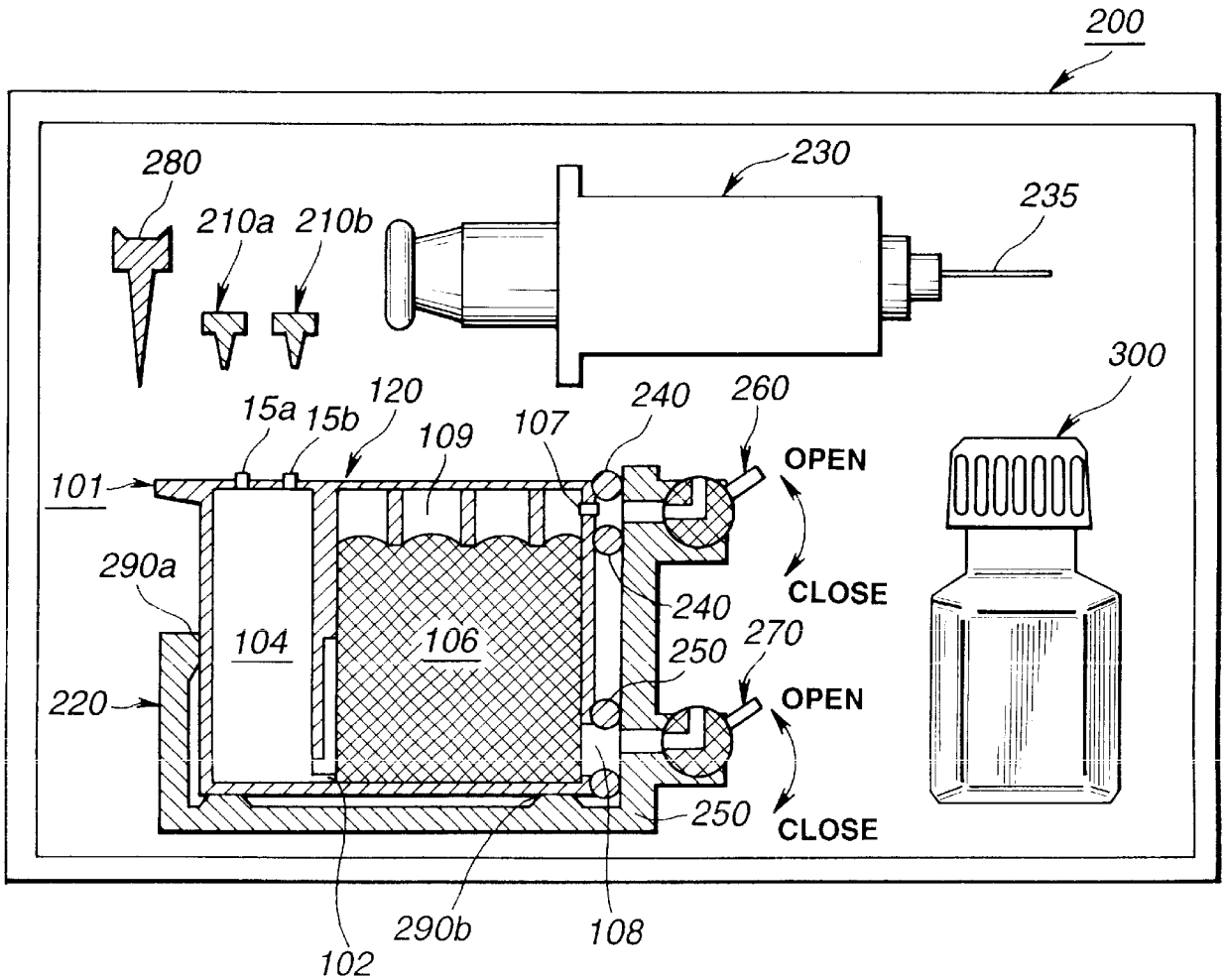
FIG. 7 is a schematic diagram illustrating the configuration of a refilling kit (filling unit) which utilizes a liquid filling method according to the present invention.
Figure 8:
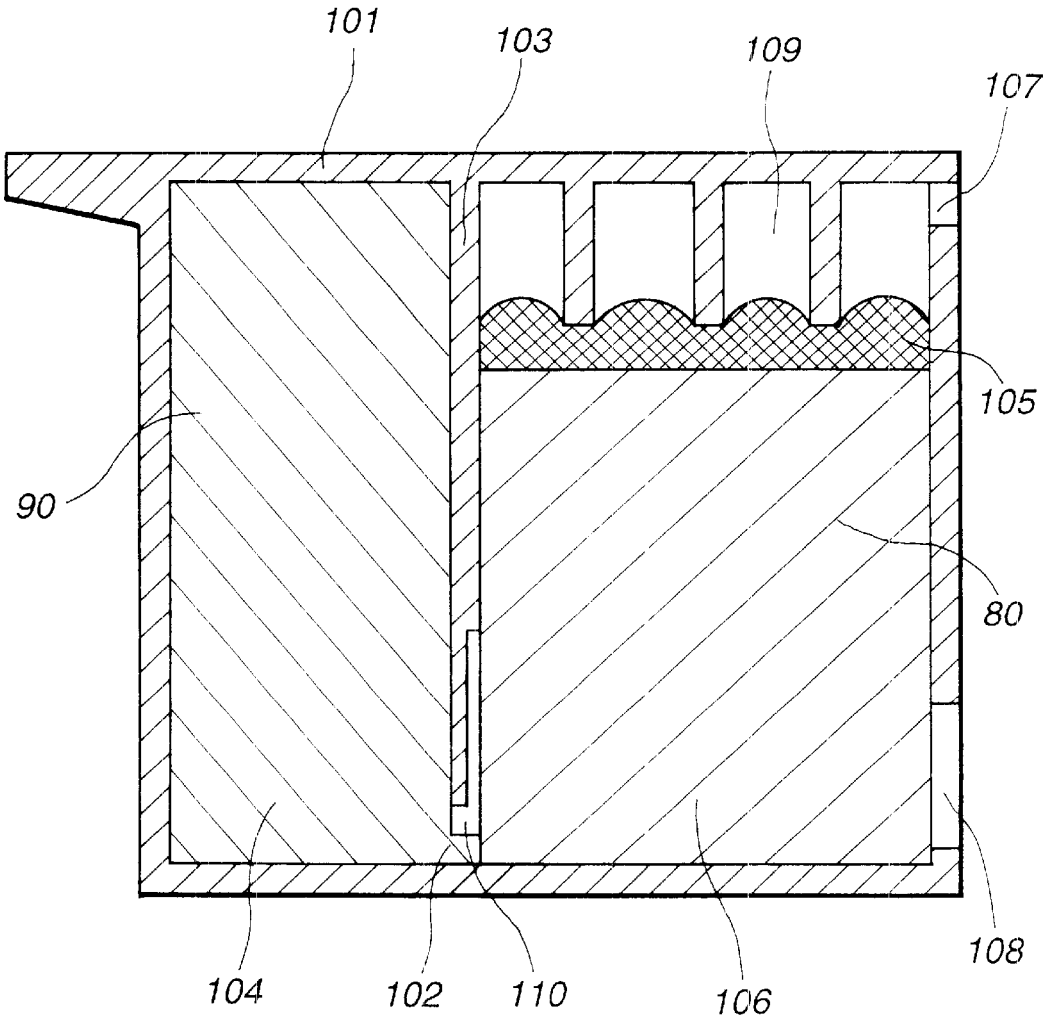
FIG.8 PRIOR ART
FIG. 8 is a schematic cross-sectional view illustrating the configuration of a conventional ink tank which utilizes a configuration proposed by the assignee of the present application.

In the foregoing description, in order to facilitate ink refilling, a refilling kit as shown in FIG. 7 may be used. The configuration of the refilling kit will now be briefly described.

FIG. 7 is a schematic diagram illustrating a refilling kit which utilizes the liquid filling method according to the first embodiment of the present invention.

A refilling kit 200 includes a liquid container 101, plugs 210*a* and 210*b* for blocking two openings 15*a* and 15*b*, respectively, of a second chamber 104 of the liquid container 101, a refilling station 220, and an liquid injector 230. The liquid container 101 need not have the openings 15*a* and 15*b* in advance. For example, the openings 15*a* and 15*b* may be provided in the second chamber using conical punching means 280 having a sharp distal end. When the openings 15*a* and 15*b* are provided in advance, these openings are sealed by sealing members, such as the above-described plugs 210*a* and 201*b*.

The liquid is replenished into the liquid container 101 according to the following procedure. First, the liquid container 101 is set in the refilling station 220. At that time, the liquid container 101 is assuredly held in the refilling station 220 by engaging portions 290*a* and 290*b* in a state in which a communicating portion 102 is placed at a lower position. In this state, an atmospheric-air communicating portion 107 and a liquid supply portion 108 are connected to opening/closing valves 260 and 270 via O-ring packings 240 and 250, respectively.

After removing the plugs 210*a* and 210*b*, and closing the valves 260 and 270, the liquid is injected through one of the openings using the liquid injector 230. When there remains no liquid in the liquid injector 230, more liquid may be injected after replenishing a necessary amount of liquid from a replenishing-liquid container 300 into the liquid injector 230. If liquid to be replenished can be provided in advance within the liquid injector 230, the replenishing-liquid container 300 may be omitted.

When injecting the liquid, if some liquid remains in the second chamber 104, leakage of the liquid to the outside during a liquid refilling operation can be prevented by first closing the valves 260 and 270 to cause the first chamber 106 to be a substantially closed space, as in the above-described refilling method.

After completing the refilling of the liquid into the second chamber 104, refilling of the liquid into the first chamber 106 is performed if necessary. In this case, by blocking an opening where the liquid injector 230 is not inserted and opening the valve 260, refilling of the liquid into the first chamber is performed. At that time, if the second chamber 104 is not a substantially closed space, the liquid in the second chamber moves to the first chamber, and the air remains in the second chamber. In order to prevent such a phenomenon, a gap between an injection needle 235 of the liquid injector 230 and the liquid supply portion may be eliminated by providing an elastic member made of rubber or the like around the opening where the liquid injector 230 is inserted, or the liquid may be again injected into the second chamber while allowing movement of the liquid from the second chamber to the first chamber and entrance of air into the second chamber. In order to avoid such a troublesome operation, the liquid may be first filled into the first chamber 106 and then filled into the second chamber 104 by adopting the injection method of the second embodiment.

After injecting a predetermined amount of liquid in the above-described manner, the valves 260 and 270 are closed, and the opening where the liquid injector 230 is inserted is blocked by the plug to assuredly cause the second chamber to be in a closed state. Thus, the refilling of the liquid is completed.

In the liquid refilling method using the above-described refilling kit, the liquid can be injected while maintaining a state in which the communicating portion 102 is placed at a lower position and the buffer portion 109 is placed at an upper position, compared with the conventional method described in Japanese Patent Laid-Open Application (Kokai) No. 6-226990 (1994).

As described above, according to the liquid filling method of the present invention for filling a liquid into a liquid container, where the liquid container includes a first chamber incorporating a negative pressure generating member and including a liquid supply portion and an atmospheric-air communicating portion, and a second chamber including a communicating portion communicating with the first chamber, for forming a substantially closed space, by prohibiting discharge of air within one of the first chamber and the second chamber, and simultaneously filling a liquid into the other chamber while discharging air within the other chamber to the outside of the liquid container, in a state in which the communicating portion is placed at a lower position in a direction of gravity, it is possible to provide a simple and high-productivity liquid filling method without using a complicated process or apparatus.

Furthermore, by prohibiting discharge of air within one of the first chamber and the second chamber by blocking the communicating portion with the liquid, and simultaneously filling a liquid into the other chamber while discharging air within the other chamber to the outside of the container, it is possible to provide a liquid filling method having a high accuracy in injection into the liquid container. Particularly, by providing a channel for introducing air near the communicating portion, the liquid can be promptly filled into a portion near the communicating portion. As a result, it is possible to shorten the filling time, and to further improve accuracy in injection of the liquid into the liquid container (particularly the first chamber).

By first filling the liquid into the first chamber, there is provided a time period to fill ink into the second chamber after filling the ink into the negative pressure generating member. Hence, this method is effective when using ink which requires a time period to be adapted to or to assume a stable state with respect to the negative pressure generating member.

By first filling the liquid into a portion near the communicating portion of the first chamber, and filling the liquid from the supply portion of the first chamber, it is possible to obtain more stable liquid supply while the liquid container is used.

By applying the liquid filling method of the present invention to a liquid refilling method, it is possible to fill a liquid in a state in which the liquid can be supplied to a liquid discharging head.

The individual components shown in outline in the drawings are all well-known in the art pertaining to the liquid filling method, the liquid filling unit, and the liquid container, and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid filling method for filling a liquid into a liquid container, the liquid container including a first chamber incorporating a negative pressure generating member and including a liquid supply portion and an atmospheric-air communicating portion, and a second chamber including a communicating portion communicating with the first chamber and forming a substantially closed space, wherein an opening for discharging air is provided at an upper surface of the second chamber, said method comprising:

prohibiting discharge of air within one of the first chamber and the second chamber, and simultaneously filling a liquid into the other chamber while simultaneously discharging air within the other chamber to atmospheric air outside of the liquid container, in a state in which the communicating portion is placed at a lower position relative to a position in actual use thereof in a direction of gravity.

2. A liquid filling method according to claim 1, wherein a region where ink is not filled is provided at a portion near an upper surface of the first chamber.

3. A liquid filling method for filling a liquid into a liquid container, the liquid container including a first chamber incorporating a negative pressure generating member and including a liquid supply portion and an atmospheric-air communicating portion, and a second chamber including a communicating portion communicating with the first chamber and forming a substantially closed space, wherein an opening for discharging air is provided at an upper surface of the second chamber, said method comprising:

prohibiting discharge of air within one of the first chamber and the second chamber by blocking the communicating portion with a liquid injected into the one chamber, and simultaneously filling the liquid into the other chamber while simultaneously discharging air within the other chamber to atmospheric air outside of the liquid container.

4. A liquid filling method according to claim 3, wherein the first chamber includes a channel for introducing air to the second chamber at a portion near the communicating portion.

5. A liquid filling method according to claim 3, wherein said filling step fills the liquid into the first chamber in a state in which the liquid supply portion is blocked.

6. A liquid filling method according to claim 3, wherein said filling step first fills the liquid into the first chamber, and afterward fills the liquid into the second chamber.

7. A liquid filling method for filling a liquid into a liquid container, the liquid container including a first chamber incorporating a negative-pressure generating member and including a liquid supply portion to be connected to a liquid discharging head and an atmospheric-air communicating portion, a second chamber including a communicating portion communicating with the first chamber and forming a substantially closed space, an opening provided at an upper surface of the second chamber, and a region where ink is not filled provided near an upper surface of the first chamber, said method comprising:

prohibiting discharge of air through the communicating portion by blocking the communicating portion by filling the liquid from a portion of the first chamber near the communicating portion, and simultaneously filling a liquid into said second chamber while simultaneously discharging air within said second chamber through the opening to atmospheric air outside of the liquid container.

8. A liquid filling method according to claim 7, wherein in said step of simultaneously filling a liquid into said second chamber, the liquid is simultaneously filled into said second chamber while simultaneously discharging air within said second chamber through the opening to atmospheric air outside of the liquid container and while blocking said liquid supply portion and said atmospheric-air communicating portion.

9. A liquid filling method for filling a liquid into a liquid container, the liquid container including a first chamber incorporating a negative-pressure generating member and including a liquid supply portion to be connected to a liquid discharging head and an atmospheric-air communicating portion, a second chamber including a communicating portion communicating with the first chamber and forming a substantially closed space, an opening provided at an upper surface of the second chamber, and a region where ink is not filled provided near an upper surface of the first chamber, said method comprising:

prohibiting discharge of air within one of the first chamber and the second chamber, and simultaneously filling a liquid into the other chamber from the liquid supply portion of the first chamber while simultaneously discharging air within the other chamber to atmospheric air outside of the liquid container.

10. A filling unit for performing a liquid filling method for a liquid container, the liquid container including a first chamber incorporating a negative pressure generating member and including a liquid supply portion and an atmospheric-air communicating portion, and a second chamber including a communicating portion communicating with the first chamber and forming a substantially closed space, wherein liquid is filled in the liquid container by prohibiting discharge of air within one of the first chamber and the second chamber, and simultaneously filling a liquid into the other chamber while simultaneously discharging air within the other chamber to atmospheric air outside of the liquid container, in a state of posture in which the communicating portion is placed at a lower position relative to a position in actual use thereof in a direction of gravity, and performing sealing in order to cause the second chamber to be a closed space except the communicating portion, said filling unit comprising:

a refilling station for controlling the discharge of air such that discharge of air is prohibited from one of the first and second chambers, said refilling station comprising a loading portion for mounting said liquid container, a first opening/closing portion which opens and closes said liquid supply portion of said liquid container mounted on the loading portion, and a second opening/closing portion which opens and closes said atmospheric-air communicating portion, wherein said refilling station opens and closes said first and second opening/closing portions to control discharge of air;

a liquid filling unit for injecting a liquid stored therein into the liquid container, such that liquid is injected in the liquid container simultaneously with prohibiting discharge of air by said refilling station and simultaneously filling a liquid into the other chamber while simultaneously discharging air within the other chamber to atmospheric air outside of the liquid container, in a state of posture in which the communicating portion is placed at a lower position relative to a position in actual use thereof in a direction of gravity; and a seal member for causing the second chamber to be a closed space except for the communicating portion.

11. A filling unit according to claim 10, further comprising punching means for providing at least one opening in the second chamber.

12. A liquid discharging recording apparatus comprising:

a liquid container, including a first chamber incorporating a negative pressure generating member and including a liquid supply portion and an atmospheric-air communicating portion, and a second chamber including a communicating portion communicating with the first chamber and forming a substantially closed space, for holding a liquid;

atmospheric-air-communicating-portion sealing means for sealing the atmospheric-air communicating portion;

a recording head for performing recording on a recording medium by discharging the liquid supplied from the liquid container; and a replenishing container for holding a liquid to be replenished into said liquid container, wherein said liquid discharging recording apparatus further comprises means for injecting the liquid into said liquid container, and means for discharging air within the liquid container to atmospheric air outside of the liquid container, in a state in which the communicating portion of said liquid container is placed at a lower position relative to a position of actual use thereof in a direction of gravity wherein said means for injecting fills liquid in the liquid container by prohibiting discharge of air within one of the first chamber and the second chamber and simultaneously filling a liquid into the other chamber while simultaneously discharging air within the other chamber to atmospheric air outside of said liquid container, in a state in which the communicating portion is placed at a lower position in a direction of gravity.

13. A liquid discharging recording apparatus according to claim 12, wherein said liquid container further includes apertures at an upper face of the second chamber, and aperture sealing means for sealing the apertures, and wherein said liquid discharging recording apparatus further comprises a cap for capping said recording head, and opening/closing means for opening/closing the aperture sealing means.

* * * * *